United States Patent [19]

Leporati

[11] 4,171,020

[45] Oct. 16, 1979

[54] CHARCOAL EXTINGUISHER

[76] Inventor: Richard Leporati, R.D. #2, Box 341, Stevens Pl., Chester, N.Y. 10918

[21] Appl. No.: 655,821

[22] Filed: Feb. 6, 1976

[51] Int. Cl.[2] ..... A62C 39/00

[52] U.S. Cl. ..... 169/49; 126/25 C

[58] Field of Search ..... 169/48, 49, 50; 126/25 R, 25 C; 15/257.1, 257.4, 257, 6; D7/104, 186, 206, 210

[56] References Cited

U.S. PATENT DOCUMENTS

| | | | |
|---|---|---|---|
| D. 175,707 | 10/1955 | Bjorncrantz | D7/210 |
| 626,096 | 5/1899 | Rice | 15/257.1 |
| 674,516 | 5/1901 | Olson | 15/257.6 |
| 2,354,762 | 8/1944 | McFerron | 169/49 |
| 2,355,428 | 8/1944 | Dunbar et al. | 169/49 |
| 2,786,463 | 3/1957 | Vincent | 126/25 C |
| 3,606,066 | 9/1971 | Anderson | 126/25 C X |
| 3,667,446 | 6/1972 | Morton | 126/25 C X |
| 3,693,534 | 9/1972 | Martin | 126/25 R X |
| 3,804,450 | 4/1974 | Guenzel | D7/104 X |

FOREIGN PATENT DOCUMENTS

| | | | |
|---|---|---|---|
| 249674 | 4/1926 | United Kingdom | D7/186 X |

*Primary Examiner*—Joseph F. Peters, Jr.
*Assistant Examiner*—Michael Mar

[57] ABSTRACT

A charcoal extinguisher that is portable and adapted to receive a quantity of glowing charcoals therein and to extinguish the flame thereof such that the same may be re-used, the device includes a triangular shaped member having a grating thereon for holding the coals until they extinguish.

7 Claims, 2 Drawing Figures

CHARCOAL EXTINGUISHER

BACKGROUND OF THE INVENTION

This invention relates to a charcoal extinguisher; more particularly, to a device that will extinguish the coals yet enable one to re-use the same at a later time. The foregoing represents both a cost savings as well as a safety feature in that the heated-glowing coals are not left in the barbeque or tossed aside where one may burn himself upon contact therewith.

The prior art teaches a variety of charcoal and barbequing devices, for example, as disclosed in U.S. Pat. Nos. 3,168,062; 3,175,549; 3,318,300; 3,382,863; 3,533,393; 3,581,731; 3,606,066; 3,851,639; and others. While charcoal extinguishers are broadly disclosed therein, the art does not teach an apparatus of the type hereinafter described and claimed.

SUMMARY OF THE INVENTION

It is accordingly an object of the instant invention to provide for an improved charcoal extinguishing apparatus.

It is another object to provide for the same at relatively little cost thereby making the same generally available.

These and other objects and advantages of the invention will become more apparent from the following detailed disclosure and claims and by reference to the accompanying drawing, in which:

Figure 1:
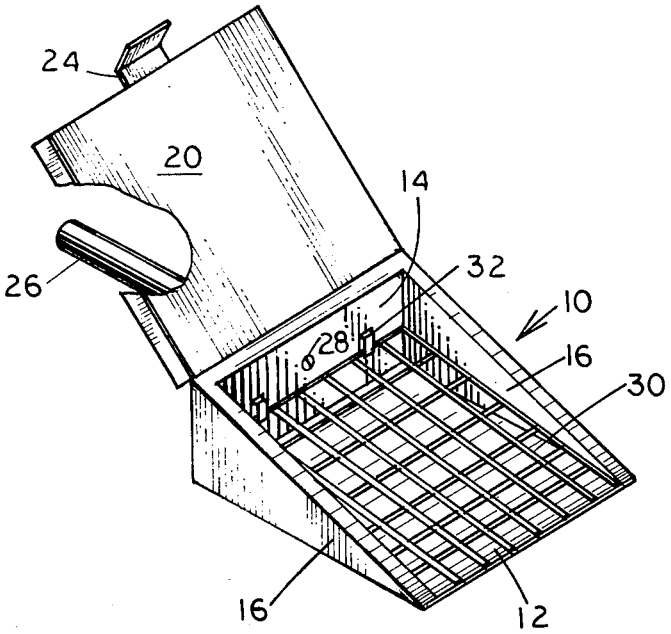
FIG. 1 is a perspective view.
Figure 2:
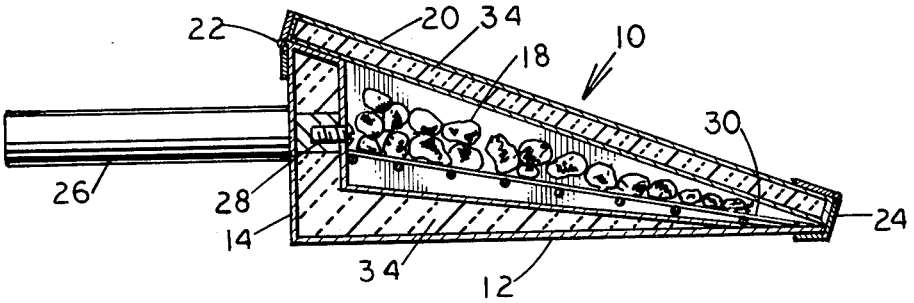
FIG. 2 is a sectional view.

Broadly speaking, the instant invention includes the provision of a charcoal extinguishing device, comprising a member having a triangular cross sectional shape and including a substantially planar base, a pair of opposing substantially parallel walls and a rear wall communicating with the base and the walls and being substantially perpendicular thereto, a movable cover section adapted to cover the member and being pivotally engaged to the rear wall and adapted to move upward and downward relative to the base, a perforate plate disposed in the member and engaging the rear wall, the plate for supporting the coals and being inclined relative to the base, the plate and the base defining a hollow area therebetween for supporting ash that passes through the plate.

DETAILED DISCLOSURE

Referring more particularly to the drawings there is shown a walled housing 10 that is preferably shovel shaped, i.e., a flat base portion 12, a rear wall 14, a pair of opposing side walls 16 that are parallel and triangularly shaped such that a scoop is formed that is adapted to scoop or shovel up coals 18 thereonto. The housing 10 will include a cover member 20 that is adapted to completely and effectively cover the open area defined by the wall sections and base. The cover 20 is adapted to open and close the housing 10 by moving between a series of positions thereover. The cover 20 is secured to the rear wall 14 by suitable means 22 such as a hinged connection or the like. The forward end of the cover 20 includes suitable means 24 for releasably engaging the same to the base portion 12, such as by a snap hinge, frictional engaging means, etc., so that the means 24 on the distal end of the cover 20 will engage the underside of the base portion 12.

Preferably affixed to the rear wall 14 there will be disposed handle means 26 that may be unitary with the wall 14 or held thereonto by suitable means 28 such as a bolt, rivet, etc.

The interior of the housing 10 will include a removable perforate mesh plate or screen 30 that is adapted to support the coals 18 thereon. The plate 30 will be disposed in the housing 10 by being movably engaged to the rear wall 14 by suitable means 32 such as hinges, hooks, etc. The plate is inclined relative to the base 12 such that it is approximately in contact therewith at the front of the housing 10 (i.e., the scooping portion) and inclines upward at an angle towards the point of engagement with the rear wall 14. All of the sides of the housing 10 are preferably insulated by a layer of a suitable insulating material 34 disposed thereon, such as a sheet of asbestos, glass, wool, etc. The material 34 can be sandwiched within the walls of the sides 14, 16, 12, 20, or merely form a laminate, such as by being disposed only on one surface thereof.

If desired, the outer surface of the cover 20 may include a lifting member that is adapted to be engaged by the hand to pull the cover upward away from the base 12. In cross section, the entire unit appears as an isocoles triangle having a handle extending therefrom, from the shortest side; due to the placement of the engaging means 24, a trapezoid may also be possible.

Since it is obvious that numerous changes and modifications can be made in the above-described details without departing from the spirit and nature of the invention, it is to be understood that all such changes and modifications are included within the scope of the invention.

I claim:

1. A charcoal extinguishing device, comprising a scoop shaped member having a triangular cross section and including a base having a planar outer wall and inclined inner wall forming a wedge, a pair of opposing substantially parallel side walls and a rear wall communicating with said base and said side walls and being substantially perpendicular thereto, a movable cover section adapted to cover said member and being pivotally engaged to said rear wall and adapted to move upward and downward relative to said base, a perforate plate disposed in said member and engaging said rear wall for supporting said coals and being inclined relative to said outer wall and rear wall, said plate and said base defining a hollow area therebetween for supporting ash that passes through said plate, said cover, side walls and base including heat insulating material.

2. The device as defined in claim 1 where said rear wall includes a handle means.

3. The device as defined in claim 1 wherein said material and said walls and base form a laminate.

4. The device as defined in claim 1 wherein said plate and said cover are substantially parallel.

5. The device as defined in claim 1 wherein said cover includes means for removably engaging the same to said base.

6. The device as defined in claim 1 wherein said plate is pivotally engaged to said rear wall.

7. The device as defined in claim 1 wherein said cover includes lifting means disposed on the outer surface thereof.

* * * * *